US008446325B1

(12) United States Patent
Tonn

(10) Patent No.: US 8,446,325 B1
(45) Date of Patent: May 21, 2013

(54) HYBRID CABLE ANTENNA FOR HIGH FREQUENCY BAND

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 445 days.

(21) Appl. No.: 12/781,147

(22) Filed: May 17, 2010

(51) Int. Cl.
*H01Q 1/34* (2006.01)

(52) U.S. Cl.
USPC ..... 343/709; 343/719

(58) Field of Classification Search
USPC ..... 343/709, 719
See application file for complete search history.

(56) References Cited

U.S. PATENT DOCUMENTS

| | | | | |
|---|---|---|---|---|
| 4,774,519 | A * | 9/1988 | Pease et al. | 343/709 |
| 5,933,117 | A * | 8/1999 | Gerhard | 343/709 |
| 6,426,464 | B1 * | 7/2002 | Spellman et al. | 174/101.5 |
| 7,868,833 | B2 * | 1/2011 | Tonn | 343/709 |
| 8,179,327 | B1 * | 5/2012 | Clark et al. | 343/709 |

* cited by examiner

*Primary Examiner* — Hoanganh Le
(74) *Attorney, Agent, or Firm* — James H. Kasischke; Jean-Paul A. Nasser; Michael P. Stanley

(57) ABSTRACT

A hybrid cable antenna includes a first cable antenna that is buoyant and unloaded for operation in a lower portion of the high frequency band. At least one second cable antenna is serially and electrically coupled to the first cable antenna. Each second cable antenna is buoyant and loaded for operation in a portion of the high frequency band that is above the lower portion of the high frequency band.

14 Claims, 2 Drawing Sheets

HYBRID CABLE ANTENNA FOR HIGH FREQUENCY BAND

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention relates generally to cable antennas, and more particularly to a buoyant cable antenna that operates through out the entire high frequency band.

(2) Description of the Prior Art

Buoyant cable antennas are generally used for submarine communication when a submarine is submerged below periscope depth. Currently, separate antennas are generally used for separate communications frequency bands. A more broadband buoyant cable antenna known as the legacy antenna achieves a compromise between very low frequency/low frequency (VLF/LF) performance and high frequency (HF) performance. However, when HF performance is important, the HF gain provided by the legacy antenna is frequently inadequate.

SUMMARY OF THE INVENTION

Accordingly, it is an object of the present invention to provide a buoyant cable antenna for operation throughout the entire high frequency band.

Another object of the present invention is to provide a buoyant cable antenna whose gain can be readily optimized across the entire high frequency band.

Other objects and advantages of the present invention will become more obvious hereinafter in the specification and drawings.

In accordance with the present invention, a buoyant cable antenna for operation in the high frequency band has a first cable antenna that is buoyant and unloaded for operation in a lower portion of the high frequency band. At least one second cable antenna is serially and electrically coupled to the first cable antenna. Each second cable antenna is buoyant and capacitively loaded for operation in a portion of the high frequency band that is above the lower portion of the high frequency band handled by the first cable antenna.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
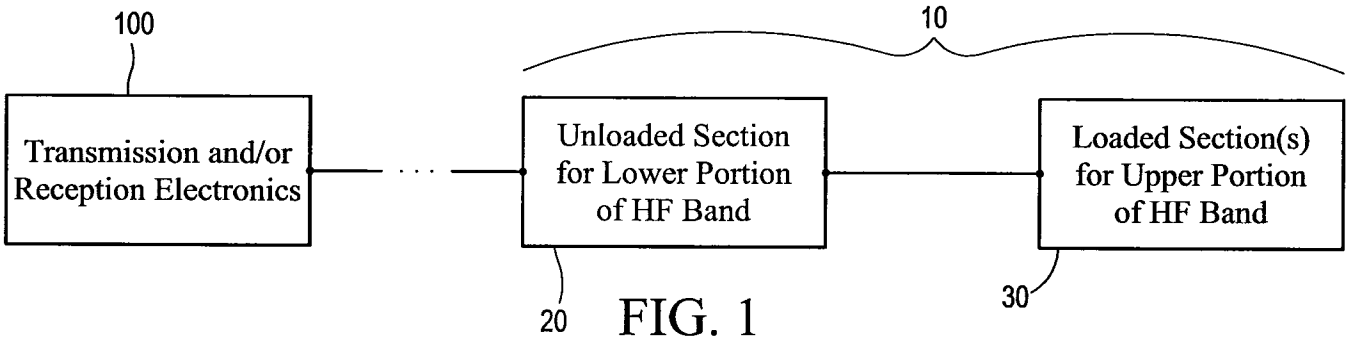
FIG. 1 is a schematic view of a hybrid buoyant cable antenna for the high frequency band in accordance with an embodiment of the present invention.

Referring now to the drawings and more particularly to FIG. 1, a hybrid buoyant cable antenna capable of operation throughout the entire high frequency band is shown and is referenced generally by numeral 10. The term "high frequency band" as used herein refers to the frequency band that is generally accepted to range from approximately 3 MHz to approximately 30 MHz as is well known in the art. However, it is to be understood that the term "high frequency band" also applies to frequency band definitions extending to frequencies below/above the generally-accepted 3-30 MHz range limits.

Buoyant cable antenna 10 is capable of functioning as several separate antennas each in its own frequency range by virtue of having multiple antenna sections. These sections include an unloaded section 20 that operates in a lower portion of the high frequency band and one or more loaded sections 30 that operate in corresponding one or more upper portions of the high frequency band. As will be explained further below, buoyant cable antenna 10 has no active devices and can be used to receive or transmit signals in the high frequency band. Accordingly, buoyant cable antenna 10 will be coupled to transmission and/or reception electronics 100, the particular design of which is not a limitation of the present invention. Unloaded section 20 is located closest to electronics 100 with loaded section(s) 30 being serially coupled to unloaded section 20.

Since buoyant cable antenna 10 will typically be deployed from a sea-going vessel, buoyant cable antenna 10 is made to be buoyant. Further, since buoyant cable antenna 10 is typically stored and deployed from a reel, buoyant cable antenna 10 must be flexible. Accordingly, embodiments of buoyant cable antenna 10 described herein will present constructions having both buoyant and flexible attributes.

Figure 2:
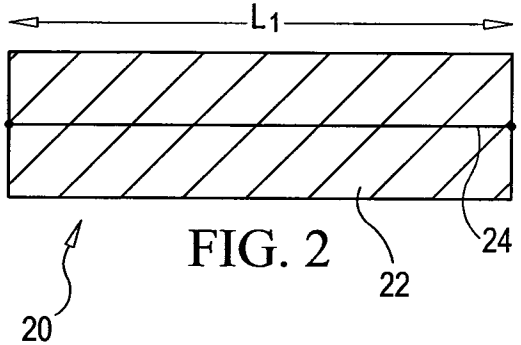
FIG. 2 is a cross-sectional view of the unloaded section of the antenna.

Referring now to FIG. 2, an embodiment of unloaded section 20 is illustrated. More specifically, unloaded section 20 is defined by a length $L_1$ of a flexible, buoyant and electronically-insulting jacket 22 that completely encases a single conducting wire 24 along its length. Jacket 22 can be made from a variety of suitable materials, such as polyethylene foam, or other closed cell foams. Wire 24 can be any electrically-conductive material such as copper or silver. The length $L_1$ of unloaded section 20 is chosen/manipulated based on a desired gain profile for buoyant cable antenna 10. In general, length $L_1$ is selected such that unloaded section 20 does not interfere with loaded section(s) 30.

Figure 3:
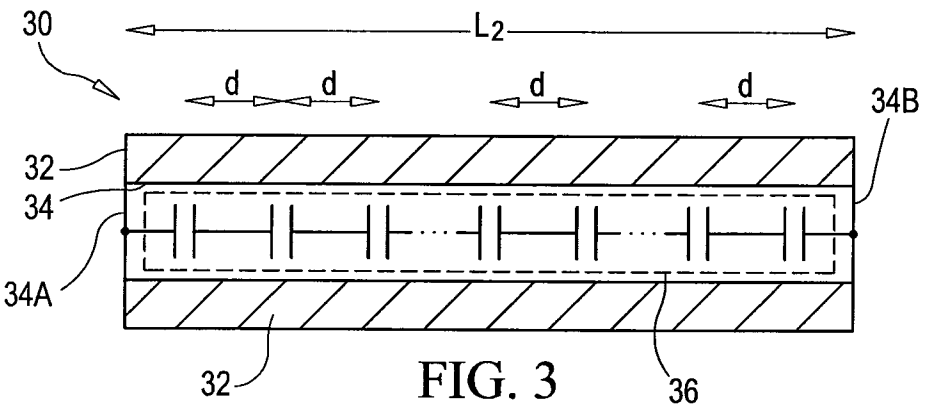
FIG. 3 is a cross-sectional schematic view of a loaded section of the antenna.

FIG. 3 illustrates an embodiment of a single loaded section 30. More specifically, loaded section 30 includes a length $L_2$ of a flexible, buoyant and electronically-insulting jacket 32 (e.g., polyethylene foam) that defines a hollowed-out passage 34 along its length and is sealed at either end 34A/34B thereof. Fitted in passage 34 is a capacitively-loaded antenna 36. In the present invention, capacitively-load antenna 36 is defined by an arrangement of equal-capacitance capacitors 38 that are connected in a serial fashion with the physical distance "d" between adjacent capacitors 38 being the same. The length $L_2$ of loaded section 30, capacitance value "C" of capacitors 38, and separation distance d, are all chosen/manipulated based on the desired gain profile for buoyant cable antenna 10. There are a variety of methods for choosing/manipulating the design parameters of loaded section 30. For example, one skilled in the art would readily be able to derive a suitable gain formulae for choosing/manipulating the design parameters of loaded section 30.

Figure 4:
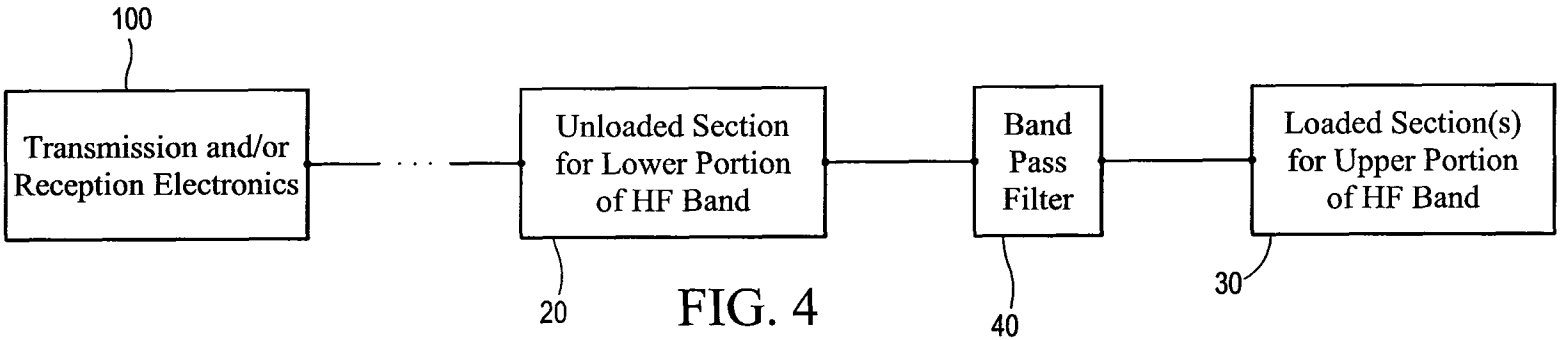
FIG. 4 is a schematic view of a hybrid buoyant cable antenna for the high frequency band in accordance with another embodiment of the present invention.

Since unloaded section 20 and loaded section(s) 30 operate at different portions of the high frequency band, it may be desirable to separate and electronically connect them using a bandpass filter designed to pass/block the relevant frequencies. Accordingly, FIG. 4 illustrates another embodiment of the present invention where a bandpass filter 40 electrically connects loaded section 20 to loaded section(s) 30. Such bandpass filters and their construction are well understood in the art.

Figure 5:
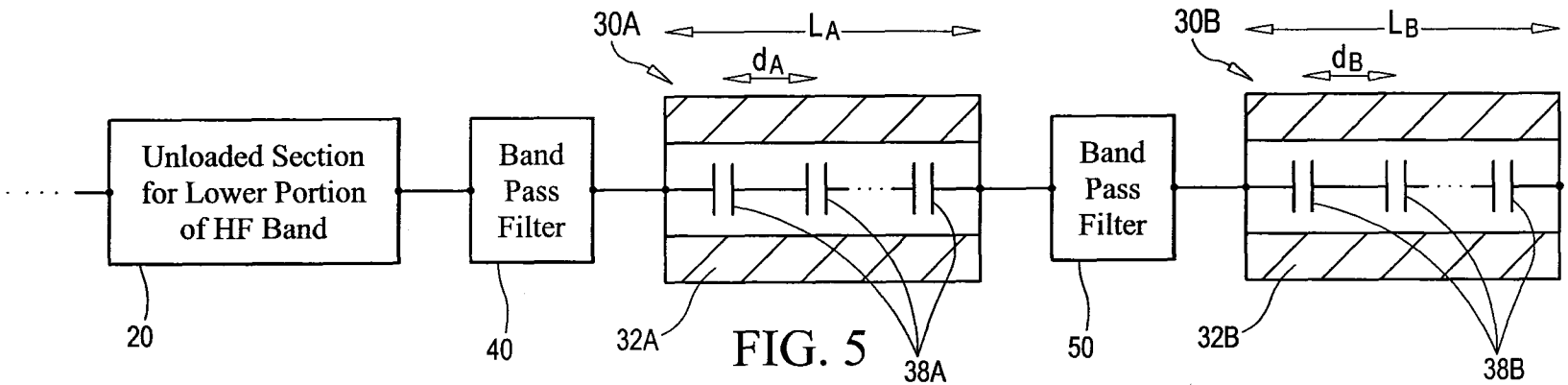
FIG. 5 is a cross-sectional schematic view of a serial arrangement of loaded sections of the antenna in accordance with another embodiment of the present invention.

In its simplest embodiment, buoyant cable antenna 10 has one unloaded section 20 covering a lower portion of the high frequency band and one loaded section 30 covering the remaining/upper portion of the high frequency band. However, in order to optimize the buoyant cable antenna in its various operating frequency ranges, it may be desirable to design and construct the buoyant cable antenna with multiple loaded sections 30. In this type of embodiment, each loaded section is optimized for a portion of the high frequency band where each portion defines a unique and non-overlapping range of frequencies that is greater than that covered by unloaded section 20. For example, FIG. 5 illustrates an embodiment of the present invention that includes two loaded sections 30A and 30B. It is to be understood that additional capacatively loaded sections could be added in serial fashion without departing from the scope of the present invention.

Loaded section 30A is optimized for a portion of the high frequency band (above the lower portion thereof defined by unloaded section 20) by manipulating the section's length "$L_A$" capacitor spacing "$d_A$," and capacitance value "$C_A$." Similarly, loaded section 30B is optimized for its portion of the high frequency band (also above the lower portion thereof defined by unloaded section 20) by manipulating the section's length "$L_B$," capacitance spacing "$d_B$," and capacitance value "$C_B$." In addition, sections 30A and 30B are designed such that the range of frequencies defined thereby increases with distance from unloaded section 20 so that the highest portion of the high frequency band is handled by the loaded section that is furthest from unloaded section 20. Since each of loaded sections 30A and 30B is designed/optimized for a particular frequency range, loaded sections 30A and 30B could also be separated/coupled by a bandpass filter 50.

The advantages of the present invention are numerous. A single hybrid cable antenna can be designed and optimized for the entire high frequency band with each section being optimized for a portion of the high frequency band. The divisions between the unloaded and loaded section(s) can also be used to provide a shunt path connection for VLF/LF transmission/reception of signals through the water.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A cable antenna for operation in the high frequency band, comprising:

a first cable antenna that is buoyant and unloaded for operation in a lower portion of the high frequency band;

at least one second cable antenna serially and electrically coupled to said first cable antenna, each said second cable antenna being buoyant and loaded for operation in a portion of the high frequency band that is above said lower portion;

wherein each said second cable antenna comprises a serial arrangement of electrically-connected capacitors, said capacitors being evenly spaced in said serial arrangement, each of said capacitors having the same capacitance; and a buoyant and electrically-insulating jacket enclosing said serial arrangement.

2. A cable antenna as in claim 1, wherein said first cable antenna comprises:

a single conducting wire; and a buoyant and electrically-insulating jacket encasing said wire.

3. A cable antenna as in claim 1, wherein each said second cable antenna is capacitively loaded.

4. A cable antenna as in claim 1, further comprising a bandpass filter electrically coupled between said first cable antenna and said at least one second cable antenna.

5. A cable antenna as in claim 1, wherein said at least one second cable antenna comprises a plurality of second cable antennas, wherein said portion of the high frequency band associated with each of said second cable antennas is unique.

6. A cable antenna as in claim 1, wherein said at least one second cable antenna comprises a serial plurality of second cable antennas, wherein said portion of the high frequency band associated with each of said second cable antennas is a unique non-overlapping band of the high frequency band, and wherein said unique non-overlapping band associated with each said portion increases in frequency with distance from said first cable antenna.

7. A cable antenna as in claim 6, further comprising a bandpass filter electrically coupled to and between adjacent ones of said second cable antennas.

8. A cable antenna as in claim 1, wherein said first cable antenna and said at least one second cable antenna are flexible.

9. A cable antenna for operation in the high frequency band, comprising:

a first cable antenna that is buoyant and unloaded for operation in a lower portion of the high frequency band, said first cable antenna defined by a single conducting wire encased in a buoyant and electrically-insulating jacket; and at least one second cable antenna serially and electrically coupled to said first cable antenna, each said second cable antenna being buoyant and loaded for operation in a portion of the high frequency band that is above said lower portion, each said second cable antenna defined by (i) a serial arrangement of electrically-connected and evenly-spaced capacitors, each of said capacitors having the same capacitance, and (ii) a buoyant and electrically-insulating jacket enclosing said serial arrangement.

10. A cable antenna as in claim 9, further comprising a bandpass filter electrically coupled between said first cable antenna and said at least one second cable antenna.

11. A cable antenna as in claim 9, wherein said at least one second cable antenna comprises a plurality of second cable antennas, wherein said portion of the high frequency band associated with each of said second cable antennas is unique.

12. A cable antenna as in claim 9, wherein said at least one cable antenna comprises a serial plurality of second cable antennas, wherein said portion of the high frequency band associated with each of said second cable antennas is a unique non-overlapping band of the high frequency band, and wherein said unique non-overlapping band associated with each said portion increases in frequency with distance from said first cable antenna.

13. A cable antenna as in claim 12, further comprising a bandpass filter electrically coupled to and between adjacent ones of said second cable antennas.

14. A cable antenna as in claim 9, wherein said first cable antenna and said at least one second cable antenna are flexible.

* * * * *